US005282328A

United States Patent [19]

Peterson

[11] Patent Number: 5,282,328

[45] Date of Patent: Feb. 1, 1994

[54] CUSTOM FOOT BEDS FOR FOOTWEAR

[75] Inventor: William E. Peterson, Lake Placid, N.Y.

[73] Assignee: Peterson Technology Trust, Manchester, Mass.

[21] Appl. No.: 911,205

[22] Filed: Jul. 9, 1992

Related U.S. Application Data

[63] Continuation-in-part of Ser. No. 677,774, Mar. 29, 1991, abandoned, which is a continuation of Ser. No. 450,220, Dec. 13, 1989, abandoned.

[51] Int. Cl.[5] ..... A43B 10/00

[52] U.S. Cl. ..... 36/154; 36/140; 5/464

[58] Field of Search ..... 36/140, 154; 5/464, 5/481

[56] References Cited

U.S. PATENT DOCUMENTS

| | | |
|---|---|---|
| 249,438 | 11/1881 | Winslow . |
| 964,119 | 11/1910 | Norton et al. . |
| 1,044,170 | 11/1912 | Guilford . |
| 1,044,171 | 11/1912 | Guilford . |
| 1,464,501 | 8/1923 | Engel . |
| 1,730,466 | 12/1926 | Mallott . |
| 1,856,394 | 5/1932 | Lettermann . |
| 2,095,268 | 10/1937 | Roberts . |
| 2,192,435 | 3/1940 | Downing . |
| 2,330,298 | 9/1943 | Vass . |
| 2,330,978 | 10/1943 | Klein . |
| 2,433,329 | 12/1947 | Adler et al. . |
| 2,440,508 | 4/1948 | Gould . |
| 2,499,324 | 2/1950 | Mead . |
| 2,565,758 | 8/1951 | Covino . |
| 2,742,657 | 2/1955 | Sloane . |
| 2,742,717 | 4/1956 | Murray . |
| 2,856,633 | 10/1958 | Murray . |
| 2,891,285 | 6/1959 | Kaplan . |
| 2,955,326 | 10/1960 | Murray . |
| 2,973,529 | 3/1961 | Silverman . |
| 3,233,348 | 2/1966 | Gilkerson . |
| 3,310,885 | 3/1967 | Alderson . |
| 3,320,347 | 5/1967 | Greenawalt . |
| 3,380,123 | 4/1968 | Schmidt . |
| 3,444,586 | 5/1969 | Dubner . |
| 3,458,898 | 8/1969 | Casparis . |
| 3,541,646 | 11/1970 | Baudou . |
| 3,655,306 | 4/1972 | Ross et al. . |
| 3,662,057 | 5/1972 | Webster et al. . |
| 3,684,417 | 8/1972 | Baudou . |

(List continued on next page.)

FOREIGN PATENT DOCUMENTS

| | | |
|---|---|---|
| 425232 | 2/1926 | Fed. Rep. of Germany . |
| 278896 | 2/1914 | Fed. Rep. of Germany . |
| 1267786 | 5/1968 | Fed. Rep. of Germany . |
| 1803145 | 9/1970 | Fed. Rep. of Germany . |
| 1509112 | 11/1966 | France . |
| 729150 | 5/1955 | United Kingdom . |

OTHER PUBLICATIONS

Biomechanical Examination of The Foot, Clinical Bio-Mechanics Corporation, 1971, Los Angeles, Calif., pp. 34–41, 60–67, 70–75, 116 and 117.

Brochure published by Sidas describing a "Conform'a-ble" footbed apparatus.

*Primary Examiner*—Richard J. Apley
*Assistant Examiner*—Linda C. M. Dvorak
*Attorney, Agent, or Firm*—Pearson & Pearson

[57] ABSTRACT

Custom molded foot beds position the feet in balanced positions. A balanced foot position represents a referenced neutral foot position compensated for an individual's particular lower body anatomy. The foot beds and the apparatus and method for making the foot beds produce a balanced position by applying forces to the foot. First forces move the foot toward the referenced neutral position by a first foam block located under the forefoot lateral column. A composite foam block produces a rolling force in the rear foot to move the subtalar joint toward alignment. Other forces provide anatomical compensation including forces that elevate the heel and cup fatty tissue around the heel. Other forces support the remainder of the foot in this balanced position.

25 Claims, 7 Drawing Sheets

U.S. PATENT DOCUMENTS 3,982,221 8/1968 Sherman et al. .
3,985,853 10/1976 Weisberg .
4,139,337 2/1979 David et al. .
4,231,169 11/1980 Toyama et al. .
4,291,428 9/1981 Anzani .
4,435,910 3/1984 Marc .
4,510,700 4/1985 Brown .
4,513,518 4/1985 Jalbert et al. .
4,522,777 6/1985 Peterson .
4,597,196 7/1986 Brown .
4,633,877 1/1987 Pendergast .
4,669,142 6/1987 Meyer .
4,718,179 1/1988 Brown .
4,747,989 5/1988 Peterson .
4,769,926 9/1988 Meyers .
4,782,605 11/1988 Chapnick .
4,868,945 9/1989 DeBettignies .
4,888,841 12/1989 Cumberland .
4,905,383 3/1990 Beckett et al. .

CUSTOM FOOT BEDS FOR FOOTWEAR

CROSS REFERENCE TO RELATED APPLICATIONS

This application is a continuation-in-part of my copending application Ser. No. 07/677,774 filed Mar. 29, 1991 which is a continuation of my application Ser. No. 07/450,220 filed Dec. 13, 1989 (now abandoned).

BACKGROUND OF THE INVENTION

1. Field of the Invention

This invention generally relates to footwear and more specifically to the structure of foot beds for such footwear and to apparatus and methods for forming such foot beds.

2. Description of Related Art

The stress that athletes place on their bones and muscles during various athletic endeavors has led to a significant body of study. One emphasis has been the interrelationship of footwear and orthopedic problems with some indication that a relationship exists between proper foot support and certain orthopedic problems, particularly those in the lower back. An important aspect of this study has been directed to determining the best position for a foot in footwear, such as in athletic footwear that includes tennis sneakers, running shoes, ski boots, golf shoes and sport walking shoes.

One consequence of these studies is a set of rigorous medical assessments of an individual's foot and lower leg. These assessments require the accumulation of data and measurements that are made while an individual assumes standing, sitting and prone positions. The objective of the data and measurements is to define the structure of a medically acceptable orthotic device. Such assessments are exacting and time consuming. They are subject to errors even when administered by qualified personnel. Moreover, it requires significant time and effort to complete an assessment and then construct an orthotic device. The costs associated with these efforts effectively limits the use of such orthotic devices to individuals who have medical requirements for such devices.

However, a wide range of individuals could benefit from various orthotic devices. Skiers, for example, often spend a significant time in adjusting the fit of their boots by returning to the vendor for the addition of wedges and other items to properly fit the boots to their feet. Runners and other athletes try several different sets of footwear in an attempt to find a pair footwear that "fits" and "feels right". In actuality, these individuals try to find that particular footwear that most closely approximates the proper fit and support for their feet. However, truly custom fitting footwear requires an individual fit for each person's feet to the footwear he or she will wear.

As previously indicated, the costs associated with a medical assessment are prohibitive. The need for developing cost effective foot supports has led to several approaches that attempt to custom fit footwear. Arch supports and wedges are examples of simple items that attempt to fit footwear. More sophisticated approaches include the formation of a molded insole that serves as a platform for a foot, normally replacing the insole supplied with the footwear. U.S. Pat. Nos. 4,139,337; 4,522,777; 4,597,196; 4,669,142; 4,718,179 and 4,803,747 disclose different molded insoles and the apparatus and methods for making such insoles.

In accordance with U.S. Pat. Nos. 4,139,337, an individual stands on a platform with cradles that locate the knees with respect to the feet. Initially, the individual stands on a glass plate so the operator can view the bottom of the feet while guiding the individual to an appropriate reference stance and positioning the knee cradles. Once the stance is obtained and the cradles are adjusted, the individual steps off the stand. An element with a molding face replaces the glass plate. This molding face receives and positions two heated thermoplastic or thermosetting insole blanks. The individual steps onto the insole blanks and assumes the previously determined reference stance. The individual maintains this stance until the insole blanks cool. Then the operator trims the insole blanks to fit inside the individual's footwear.

U.S. Pat. No. 4,522,777 discloses an embodiment of molded insoles. In accordance with this patent, an individual stands on preheated insole blanks that, in turn, are positioned on a specially shaped resilient foam cushion. The individual's feet fully compress a portion of the cushion directly under the balls of the feet. The arch and rear portion of the foot only partially compress the corresponding portions of the cushion. As a result, the ball of each foot is immobile, while the arch and rear portion are mobile and float in the cushion. The cushion has a slight upward slope from back to front that tends to stretch out the toes which in turn tighten the muscles and tendons to make the foot more stable during the molding operation.

In accordance with U.S. Pat. No. 4,597,196, the individual being fitted for a molded insole sits while the operator sizes a three-component blank and heats the components. When the blank is properly heated and assembled, the operator straps the blank to the bottom of the individual's foot and encases the foot and lower leg in a plastic bag. Then the operator draws a vacuum inside the bag apparently so atmospheric pressure on the outside of the bag presses the blank against the bottom of the individual's foot. The operator then positions the foot to lock the midtarsal joint and assists the individual to stand so his or her foot only lightly contacts a mold base. After a few seconds, the individual divides his or her weight equally between both feet, flexes his or her knees and then sits. The operator then lifts the individual's foot and repositions it to lock the midtarsal joint until the insole blank cools and sets.

A molded insole constructed in accordance with U.S. Pat. No. 4,669,142 comprises a one-piece blank that forms to the bottom of the foot. More specifically, an individual stands on compressible foam and assumes a reference position. For example, a skier will assume a downhill skiing position with the knees flexed. The foam forms a negative impression of the individual's foot in its natural position. Then the individual stands on the heated blank that is disposed in the negative impression thereby sandwiching the blank between the individual's foot and the impression while the blank cools. Various abnormalities can be compensated by adding pads to the blank or by positioning of the feet and legs during the molding operation.

U.S. Pat. Nos. 4,718,179 and 4,803,347 disclose custom molded insoles that are a variation of the molded insoles disclosed in U.S. Pat. No. 4,597,196. In this approach a heated blank is strapped to the bottom of a foot and the foot and blank are then encased in a plastic bag. A vacuum is drawn inside the bag allowing the atmospheric pressure to act on the bottom or exterior surfaces of the blank thereby molding it to the bottom of the foot. During this process an operator takes the foot, which is in a non-load bearing condition, and moves the foot until the midtarsal joint locks or nearly locks.

In summary, each of these references discloses a method and apparatus for producing a molded insole for footwear. In each the foot is in either a load-bearing or non-load bearing condition. In each the accuracy of the final mold depends entirely on or at least in a significant part on the skill of the operator in positioning the foot. Further, the prior art apparatus and methods compensate the foot only in one of the sagittal, frontal or transverse planes. It has been recognized, however, that the motion of the foot is complex and that any motion in one plane (e.g., the sagittal plane) produces motion in the other planes (e.g., the frontal and transverse planes). Any device for supporting feet effectively must therefore take into consideration the forces acting on and the motions of the foot in all three planes. In the prior art such compensation has been limited to custom formed foot beds that have been expensive to produce and have required sophisticated personnel in their manufacture.

SUMMARY

Therefore it is an object of this invention to provide foot beds that support the feet properly.

Another object of this invention is to provide foot beds that support an individual's feet properly in the sagittal, transverse, and frontal planes.

Still another object of this invention is to provide a foot bed that is easy to manufacture.

Still another object of this invention is to provide an easily implemented method for producing foot beds.

Yet still another object of this invention is to provide apparatus for facilitating the production of foot beds.

Still another object of this invention is to provide footwear with foot beds that properly position the foot.

In accordance with this invention, apparatus for forming a foot bed includes foam shapes of different densities to be disposed at least under a rear foot. These foam shapes produce simultaneously a series of opposing forces at different positions on an individual's foot as dominant forces that place the foot in a balanced or nearly balanced position when the individual assumes a normal anatomical stance. This enables a technician to manipulate the foot to a referenced neutral position for the foot compensated for the particular characteristics of an individual's lower body anatomy.

Alternatively, a combination of the foregoing apparatus with additional foam blocks for underlying the forefoot produces a series of forces that can move the foot to the referenced neutral position without the need for any external manipulation.

A moldable foot bed replicates these forces in a normal anatomical stance thereby to support the foot with the same forces that the apparatus produces. By starting with the feet in a balanced position during a normal anatomical stance, an individual will, for any given activity, place less stress on the ligaments and supporting tissue and more stress on the bone structure that is designed to carry the stress.

More specifically, certain forces that the apparatus and the foot beds produce tend to move the foot to the reference neutral position. One force acts on the rear foot essentially in the frontal plane and applies a moment that aligns the subtalar joint between the talus and the calcaneus and aligns the talu-navicular joint between the talus and the navicular. Another force acts on the forefoot to lock the midtarsal joint. Other forces compensate for the individual's particular lower body anatomy. For example, a vertical force on the heel properly aligns the tibia and talus. A cupping force at the heel contains fatty tissue at the calcaneus.

BRIEF DESCRIPTION OF THE DRAWINGS

This invention is pointed out with particularity in the appended claims. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

The application of this invention to foot beds for footwear including the apparatus and method for forming foot beds is best understood by reviewing the anatomy and motions of the foot. The foregoing patents and following document describe the anatomy of the foot and various procedures for making medical assessments and manufacturing orthotic devices and molded insoles:

Root, Merton L. et al, *Biomechanical Examination of the Foot, Vol. 1,* Clinical Biomechanics Corporation, Los Angeles 1971.

"*When The Feet Hit The Ground Everything Changes*". *A Summary of a Three-Day Practical Summary on Biomechanics of Human Gait,* The American Physical Rehabilitation Network, 1984 and 1896.

*Lower Limb Orthotics,* New York University Medical Center 1986.

Figure 1:
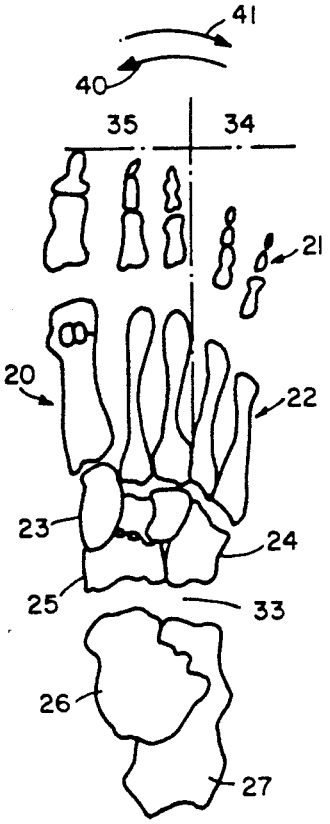
FIG. 1 is a transverse view of an individual's right foot.
Figure 2:
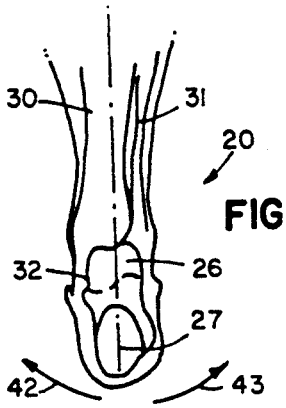
FIG. 2 is a view of the foot of FIG. 1 in the frontal plane, but viewed from the rear.
Figure 3:
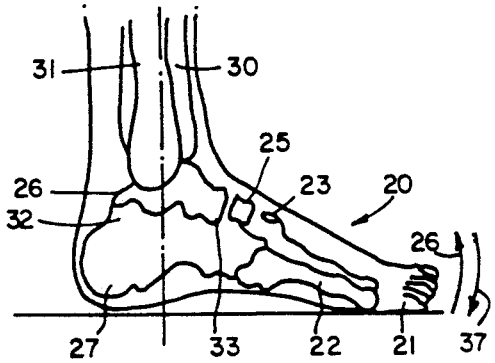
FIG. 3 is a view of the foot in FIG. 1 in a sagittal plane viewed from the right.

FIGS. 1 through 3 depict the various bones and joints in a right foot and lower leg 20 that are useful in a understanding of this invention. Referring to FIG. 1 the phalanges 21 form the toes and connect to metatarsals 22 that in turn attach to cuneiforms 23. These represent the primary components of the forefoot and attach to the cuboid 24 and the navicular 25. The talus 26 is an interconnecting structure between the navicular 25, the calcaneus 27, the tibia 30 and the fibula 31. The subtalar joint 32 constitutes the interface between the talus 26 and the calcaneus 27. A midtarsal joint 33 comprises the interface between the cuboid 24, navicular 25, talus 26 and the calcaneus 27.

The foot is divided into two columns. As shown in FIG. 1 a lateral column 34 comprises the calcaneus 27, the cuboid 24 and the fourth and fifth ray of the phalanges 21 and metatarsals 22. This represents the outer portion of the foot including the fourth and fifth toes. A medial column 35 consists of the talus 26, the navicular 25 and rays one, two and three of the metatarsals 22 and phalanges 21. This corresponds to the inner section of the foot including the first three toes or digits.

Component motions in single planes often define complex motions and include dorsiflexion and plantar flexion in the sagittal plane, adduction and abduction in the transverse plane and inversion and eversion in the frontal plane. As shown in FIG. 3 the foot undergoes dorsiflexion when the distal end of the foot elevates toward the leg as represented by arrow 36; plantar flexion is the reverse motion as represented by arrow 37. Adduction is motion toward the midline of the body represented by arrow 40 in FIG. 1; abduction is motion away from the midline of the body as represented by arrow 41. As shown in FIG. 2, inversion is movement of the foot toward the midline of the body represented by arrow 42 whereas eversion is movement of the foot away from the midline of the body as represented by arrow 43.

As previously indicated, foot motion in any one plane involves motion in the others. The complex motions are called "pronation" and "supination" and they include motions with respect to the ankle, subtalar and midtarsal joints. Pronation includes dorsiflexion, abduction and eversion; supination includes plantar flexion, adduction and inversion. During pronation dorsiflexion is prominent at the ankle joint while eversion and abduction are prevalent at the subtalar joint; eversion is prominent at the longitudinal midtarsal joint an dorsiflexion and abduction are prominent at the midtarsal joint.

In general terms, a foot is considered to be in a neutral position when the subtalar joint is in its neutral position an the forefoot has been locked against the rear foot. This is the "referenced neutral position" in the following discussion. The subtalar joint neutral position is defined as the position of the subtalar joint where the joint is congruent (i.e., the talus and calcaneus are on top of one another and the talus and navicular are congruent) and a bi-section of the lower one-third of the leg creates an angle with a bi-section of the posterior portion of the calcaneus. Ideally this occurs when the angle is about 3° to 4° varus (i.e., a fixed position of eversion) with the bi-section of the posterior portion of the calcaneus. The forefoot is locked against the rear foot by applying a force against the fourth and fifth metatarsal heads.

A medical assessment considers all these motions and the effects at the various joints by monitoring foot positions for normalcy criteria. These criteria include the following:

1. The leg is vertical,
2. The knee, ankle and subtalar joints lie in transverse planes parallel to a supporting surface,
3. The subtalar joint rests at its neutral position,
4. The bi-section of the posterior surface of the calcaneus is vertical,
5. The midtarsal joint is locked in its maximum position of pronation,
6. The plantar forefoot plane parallels the plantar rear foot plane and both parallel the supporting surface,
7. Metatarsals 2, 3, and 4 are in a totally dorsiflexed position,
8. The plantar surface of the metatarsal heads describe a common plane parallel to the supporting surface,
9. Metatarsals 1 and 5 are maintained in such a position that the plantar surface of these heads lie in the same transverse plane as the metatarsal heads of 2, 3, and 4.

As described in the foregoing references a medical examination of the foot for purposes of ascertaining the deviations from normalcy is extensive, complex and requires sophisticated individuals. In prior art systems for forming foot beds for footwear of the type disclosed in the above-mentioned patents, attempts have been made to approximate these measurements. However, they have relied entirely on correcting motion in only a single plane, typically the frontal plane. They have not addressed the complex motions of supination and pronation. Moreover even in the medical systems there are wide range of potential errors that must be monitored in order to provide proper orthotic device. As a result this procedure is very expensive and time consuming.

In accordance with this invention it has been found that balanced foot position exists for each individual when that individual assumes a normal anatomical stance. In the following discussion, reference to the balanced position will imply that the individual is in a normal anatomical stance. The normal anatomical stance exists when an individual is standing with the ankle, knee, hip and shoulders in vertical alignment. The individual's feet are spread slightly apart. The weight is evenly distributed between the feet and between the heel and the ball of each foot. When an individual begins activities with the feet in the balanced position, stresses, to the extent possible, shift to the bones and away from ligaments and tissue for a wide range of activities.

The balanced position for an individual may, or may not, correspond to an anatomical or referenced neutral foot position. The degree of correspondence depends upon each individual's lower body anatomy. Thus, to achieve a balanced position in accordance with this invention, a foot bed must position the foot so it deviates from the referenced neutral position by an amount that compensates for that individual's particular lower body anatomy.

More specifically, it has been found that pillows, as shown in FIGS. 4 through 8, exert simultaneously a set of forces on a foot bed blank and a foot to locate the foot in a balanced position for an individual and to shape the foot bed to the plantar surface of the foot while the foot is in its properly balanced position. During the molding process, the foot bed essentially "memorizes" the forces. Thus, when an individual steps onto his or her foot bed in footwear, the foot bed exerts essentially the same forces as the corresponding pillows did to support and position the foot in the balance position.

Figure 4:
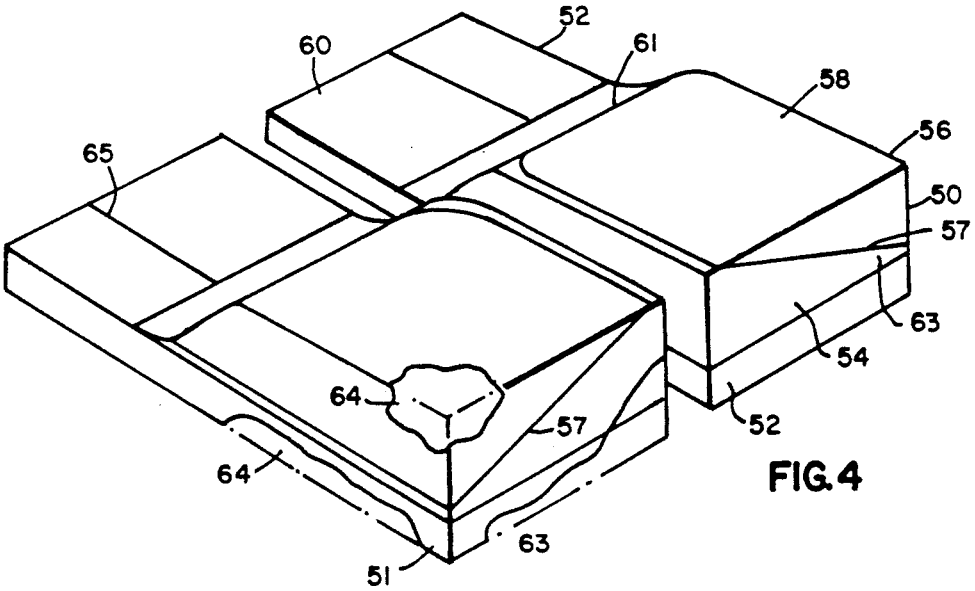
FIG. 4 is perspective view of the pillows utilized to position feet in accordance with this invention.
Figure 5:
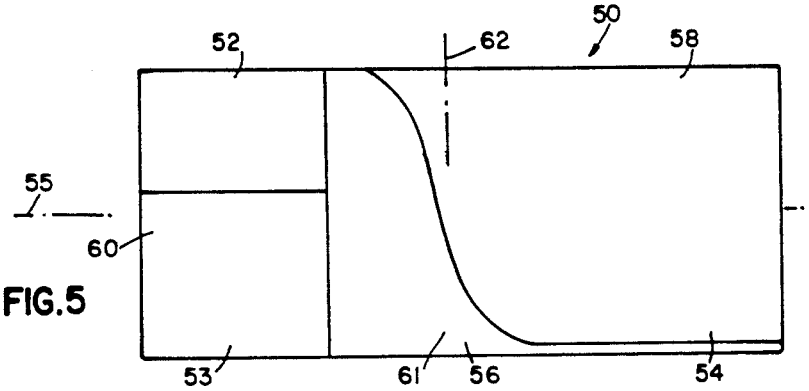
FIG. 5 is a top view of the right pillow shown in FIG. 4.
Figure 6:
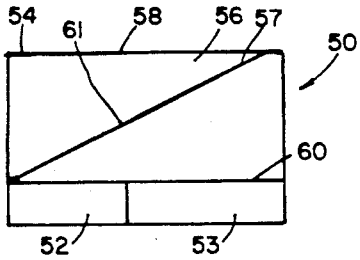
FIG. 6 is a front view of the right pillow shown in FIG. 4.
Figure 7:
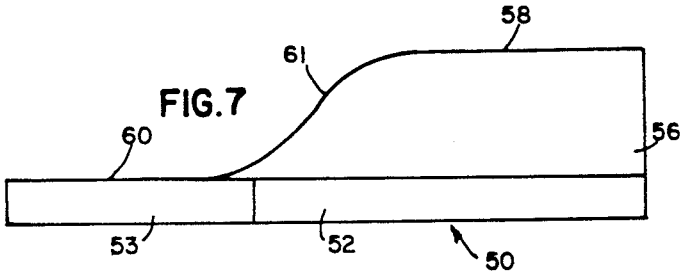
FIG. 7 is a side view of the right pillow shown in FIG. 4 as seen from between the pillows shown in FIG. 4.
Figure 8:
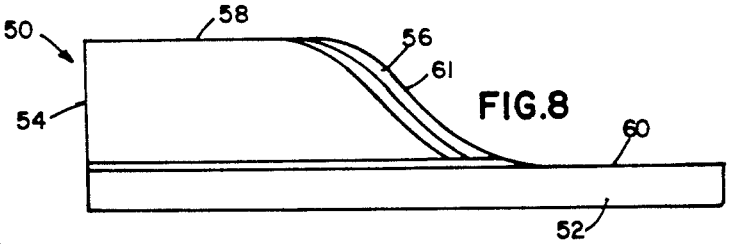
FIG. 8 is the other side view of the right pillow shown in FIG. 4.

Referring to FIG. 4, two pillows 50 and 51 produce the initial set of forces and aid in the formation of the molded foot beds. FIGS. 5 through 8 are details of the right pillow 50; the left pillow 51 is constructed as a mirror image of the right pillow 50.

More specifically, an essentially rectangular foam block 52 constitutes an underlying layer for the pillow 50 except for a notch that a rectangular foam block 53 fills. Another foam block 54 has an essentially triangular cross-section with respect to an axis 55 shown in FIG. 5. A complementary foam block 56, also with triangular cross-section, forms a composite block with an essentially rectangular cross section as the blocks 54 and 56 are attached at oblique surfaces through a line 57 that is an hypotenuse. This composite block lies on top of the foam block 52; it also has a contoured upper surface that provides a transition between an elevated top surface 58 of the block 56 and the lower top surface 60 formed by the tops of the blocks 52 and 53. The contour produces a rounded transition section 61 between the upper surfaces 58 and 60. This transition section 61 also lies in planes that are skewed with respect to a horizontal axis 62 that is transverse to the axis 55. The contour normally is skewed in a range between 0° and 20°.

By way of illustration, a typical pillow is about 14 inches long and 6 inches wide. The upper surface 58 is between 3¾ and 4 inches above a supporting surface. The foam pieces 52 and 53 are about 1 inch thick. With these dimensions, an angle 63, shown in FIG. 4, between the hypotenuse interface and the horizontal is between 20° and 30°, as determined primarily by the pillow dimensions. In use, a cover 64 contains the foam blocks 52, 53, 54 and 56.

In accordance with this invention the foam blocks have different densities. Relatively, the foam block 52 is the most dense; the foam blocks 53 and 56, the least dense. The foam block 54 has an intermediate density. It is the combination of these densities and the shapes that provide forces to position the foot in its balanced position when an individual stands on the pillows properly in a normal anatomical position. Specific densities depend upon general weight ranges and the angle 63. For an angle of 24° typical durometer readings for the foam blocks for two weight ranges are as follows:

TABLE

| RELATIVE FOAM DENSITIES | | |
|---|---|---|
| Foam block | <190 lbs. | >190 lbs. |
| 52 | 90 | 115 |
| 53,56 | 27 | 35 |
| 54 | 60 | 80 |

Before describing the forces that the pillows shown in FIGS. 4 through 8 produce in an actual molding operation, it will be helpful to describe a foot bed blank that is particularly useful in practicing this invention. Each foot bed blank comprises two pieces as disclosed in FIGS. 9 through 11. A lower heel cap 66 formed of a thermoplastic material has a cupped portion 67 as best shown in FIGS. 10 and 11. The cupped portion 67 conforms to the heel of an individual's foot. An integral support section 70 extends and flares from the heel to terminate at a planar end 71. The individual's foot size and the end use for the footwear determine the actual size of any lower heel cap 66 that will be used.

The end use determines the degree of flexibility or forefoot support that can be provided. For example, gait related activities such as running and walking require maximum flexibility between the metatarsals and the phalanges. For these activities the end 71 normally will be positioned just to the rear of the metatarsal heads. For other activities such as skiing and bicycling forefoot support is more important. For these activities the end 71 normally will be positioned between the phalanges and the metatarsals.

Typically a conventional thermosetting adhesive material coats an inner surface 72 of the cap 66. An upper component 73 of the foot bed blank is a composite; a lower portion 74 comprises any of several known thermomolding materials and an upper portion 75 comprises a similar material. The bottom surface of the lower portion 74 is relieved to form a recess 76 that receives and positions the heel cap 66. When the heel cap 66 and upper component 73 are joined, heated and placed on a pillow, such as pillow 50 in FIG. 4, between the pillow and the individual's foot, the adhesive on the surface 72 on the lower heel cap 66 bonds to the lower portion of the upper component 73 at the recess 76, so the lower heel cap 66 and the upper component 73 form a unitary structure.

Typically the lower heel cap 66 and upper component 73 curve along their lengths, the areas of these curves being designated by reference numerals 77A and 77B in FIG. 10. This curvature corresponds to a typical arch configuration. It provides initial positioning for the lower heel cap 66 and upper component 73 to facilitate the final molding to the foot over that which would be provided by a flat blank or blank of other shape.

Figure 9:
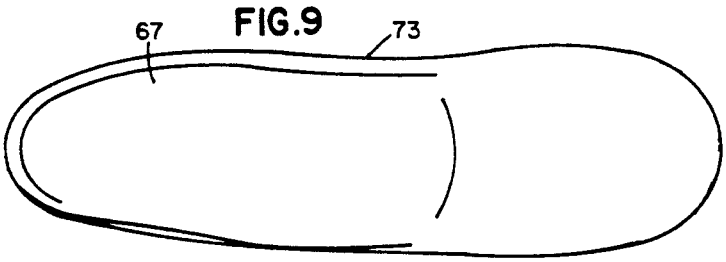
FIG. 9 is a top view of a blank used to form an foot bed in accordance with this invention.
Figure 10:
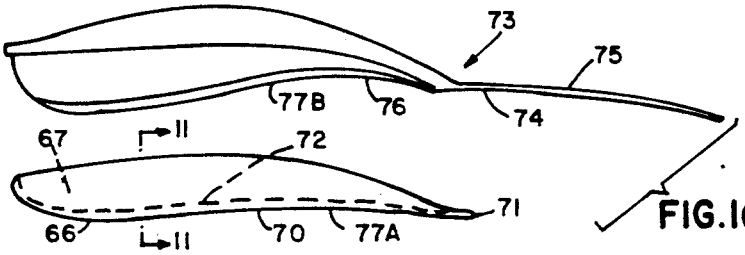
FIG. 10 is an exploded view of a blank as shown in FIG. 9.
Figure 11:
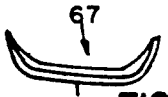
FIG. 11 is a section taken along lines 11—11 in FIG. 10.
Figure 12:
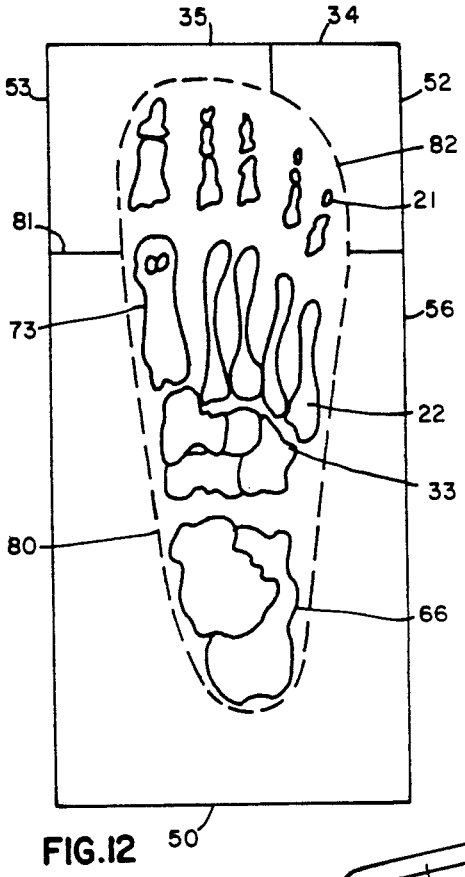
FIG. 12 is a view from the transverse plane useful in understanding the interrelationship between a foot bed blank, a foot and a pillow in accordance with this invention.
Figure 13:
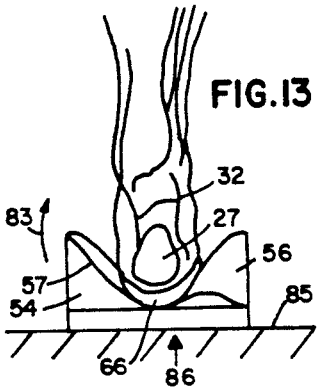
FIG. 13 is a view in the frontal plane taken from the rear of the structure shown in FIG. 12.
Figure 14:
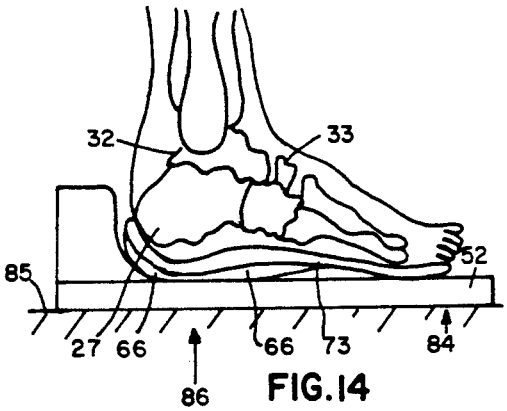
FIG. 14 is a view in the sagittal plane of the structure shown in FIG. 13.

When an individual stands on the pillows 50 and 51 shown in FIG. 4 with a blank shown in FIGS. 9 through 11 between a foot and a corresponding pillow, the pillow exerts the previously described and other forces that move the foot to a balanced position. Referring to FIGS. 12 through 14, the lower heel cap 66 lies under the heel and terminates at a dashed line 80 in FIG. 12 that corresponds to the outside of the lower heel cap 66. The lower heel cap 66 may extend to a line 81 that is located below the juncture of the metatarsal heads and the phalanges 21. The overlying upper component 73 extends over the full extent of the foot as represented by dashed line 82. The foot is located generally centrally on the pillow 50 from left to right in FIG. 12.

More specifically, the ends of the metatarsals 22 lie at about the transition between the blocks 52 and 56. Further the 4the and 5the digits overlie the block 52 and the 1st, 2nd and 3rd digits overlie the block 53. When an individual stands on the pillows 50 and 51 in FIG. 4 with his or her weight balanced, several dominant forces act on an intermediate heated blank and foot. These forces collectively position the foot in a balanced position and conform the blank against the plantar surface of the foot.

More specifically, when an individual steps on the pillow 50 with an intermediate heated blank, the heel initially sinks into the pillow 50. As this occurs, the foam blocks 54 and 56 begin to compress and produce a force that is oblique to the hypotenuse line 57. This force acts as a rolling force or moment shown by arrow 83 in FIG. 13; and this force acts on the medial column 35 to move the foot toward a neutral position of the subtalar joint 32. This force also overcomes any tendency of the foot to evert. Moreover, the foam blocks deform around the heel to position the heel while preventing adduction or abduction.

When the individual assumes a normal anatomical stance, foam block 52 produces a vertical force 84 on the lateral forefoot column 34 as shown in FIGS. 12 and 14. This dorsiflexes the lateral forefoot and locks the forefoot upon the rear foot at the midtarsal joint 33. As the block 53 has a very low density, the medial column 35 floats and essentially no force is applied in the forefoot medial column 35. Thus, the forefoot remains parallel to a supporting surface 85 shown in FIGS. 13 and 14 and the foam block 52 prevents any inversion.

If an individual has no lower body anatomical deformities, each pillow positions a foot in the referenced neutral position in all planes as this is also the balanced position. That is, the foot and lower leg meet the previously described criteria for normalcy. However, most individuals have at least one deformity that dictates the balanced and referenced neutral positions should not be the same.

For example, forefoot equinus represents a structural limitation in dorsiflexion. When an individual has forefoot equinus, the heel or calcaneus elevates above the forefoot in the natural position of the foot. If this relative position is not maintained and the calcaneus drops into the same plane on the forefoot, an individual tends to lose balance and compensates by leaning forward at the ankle or hip joint. When an individual stands on the pillows 50 and 51, the foam blocks 54 and 56 also produce a vertical force component 86 as shown in FIG. 14 that elevates the heel when the individual stands in a correct anatomical stance.

As another example, each individual has a certain amount of fatty tissue below the heel. This fatty tissue partially determines the heel elevation and acts as a shock absorber for the calcaneus. Therefore, it is important to take this fatty tissue into account. The forces acting on the heel, particularly with the blank, cup this fatty tissue thereby to contain the tissue. Moreover, the containing force is stronger in the medial column. As a result, the molded foot bed will also contain this fatty tissue so it acts as a shock absorber for the calcaneus 27 in the footwear; otherwise the calcaneus 27 is subjected to increased shocks.

When an individual stands on the pillows with a blank as shown in FIG. 9 heated into its elastic range, the blank and the foot together are properly positioned. As the blank cools, the various uneven forces from the pillow mold the blank to the plantar surface of the foot.

Specifically, the forces that orient the foot are dominant. However, the configuration of the pillow and the forces directed to the other portions of the foot, although less effective, are sufficient to mold the blank to the plantar surface. Thus, the transition section 61 causes the mold blank to form an appropriate arch support. The skewing of the transition surface 61 further assures the alignment of joint between the metatarsals 22 and phalanges 21, particularly between the 4the and 5the rays without exerting other than a conforming force on the foot.

Thus, when the individual stands on the pillows, the foot and lower leg are properly aligned in a referenced neutral position. The subtalar joint is neutral and the midtarsal joint 33 is properly aligned such that it defines a smooth s-curve when viewed from the side as depicted in FIG. 14 except for variations needed to compensate lower body anatomy.

After the blanks cool, normally in about 1 minute, the molded foot bed is removed. Typically the blanks are molded independently (i.e., one after the other). When both blanks are molded, they are trimmed, if necessary, and inserted into the footwear as insoles. When an individual subsequently steps into the footwear, each foot bed reorients each foot to its balanced position by exerting the same forces that the pillow exerts on the foot during the molding operation.

Figure 15:
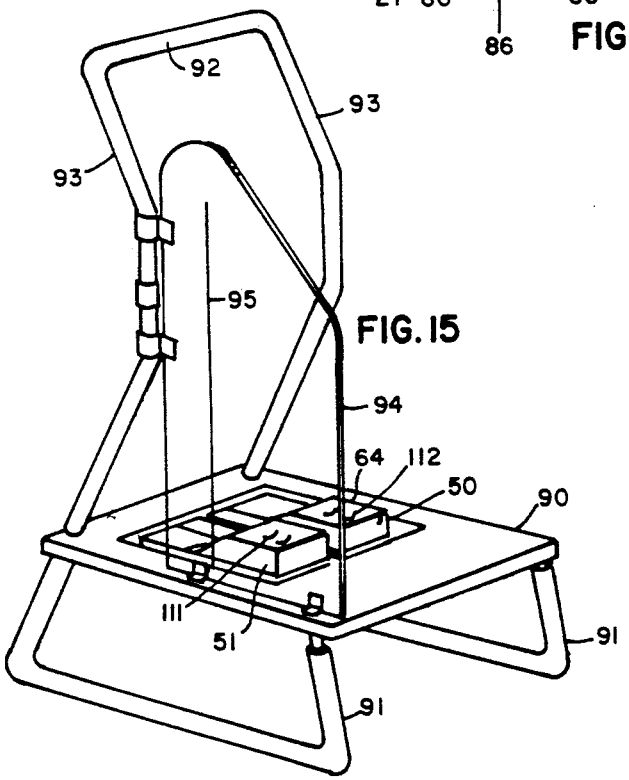
FIG. 15 is a perspective view of a stand for implementing this invention.

FIG. 15 depicts one embodiment of the apparatus for use in practicing this invention. Specifically the apparatus comprises a horizontal planar table 90 elevated on tubular legs 91 and having a tubular horizontal handle 92 supported between two upstanding arms 93. Pillows 50 and 51 for the right and left foot respectively are located on the table 90. A side panel 94 with a vertical fiducial mark 95, typically an opaque vertical line on a clear plastic panel, aids in establishing an individual's correct anatomical stance with a vertical alignment of the ankle, knee and pelvis.

Although the molded foot bed will be formed to accommodate forefoot equinus in the pillows 50 and 51, the molded foot bed is still relatively flexible. Without a support to maintain the heel cap 66 in an elevated position, an individual's weight lowers the heel cap 66, so the forefoot equinus problem remains. Thus, it is necessary to have the footwear with a proper heel height or to place a wedge of appropriate thickness under the heel cap 66 to maintain the correct elevation.

Figure 16:
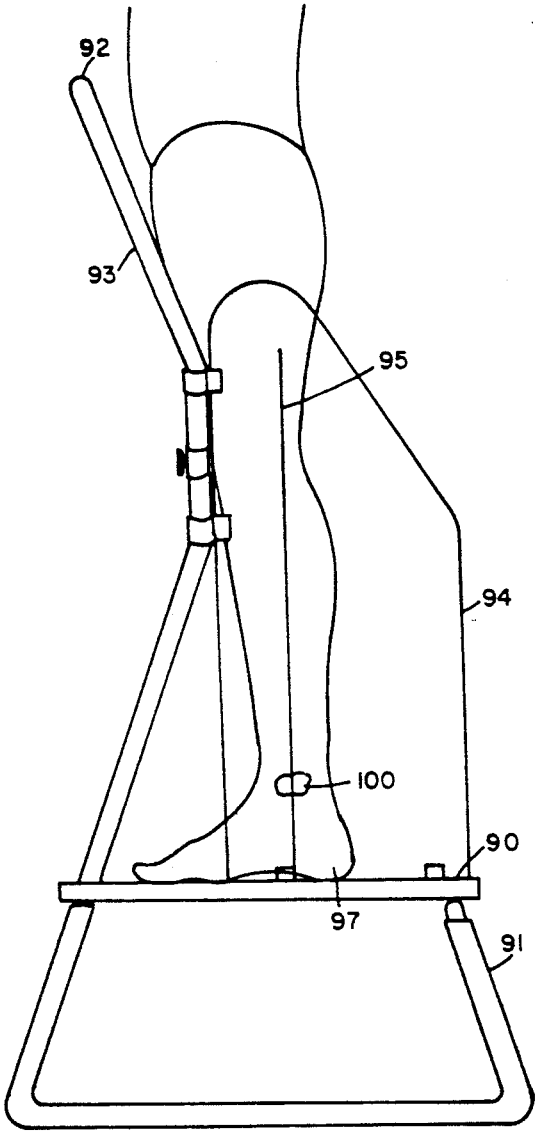
FIG. 16 is a side view of the apparatus shown in FIG. 15 illustrating the compensation of forefoot equinus.
Figure 17:
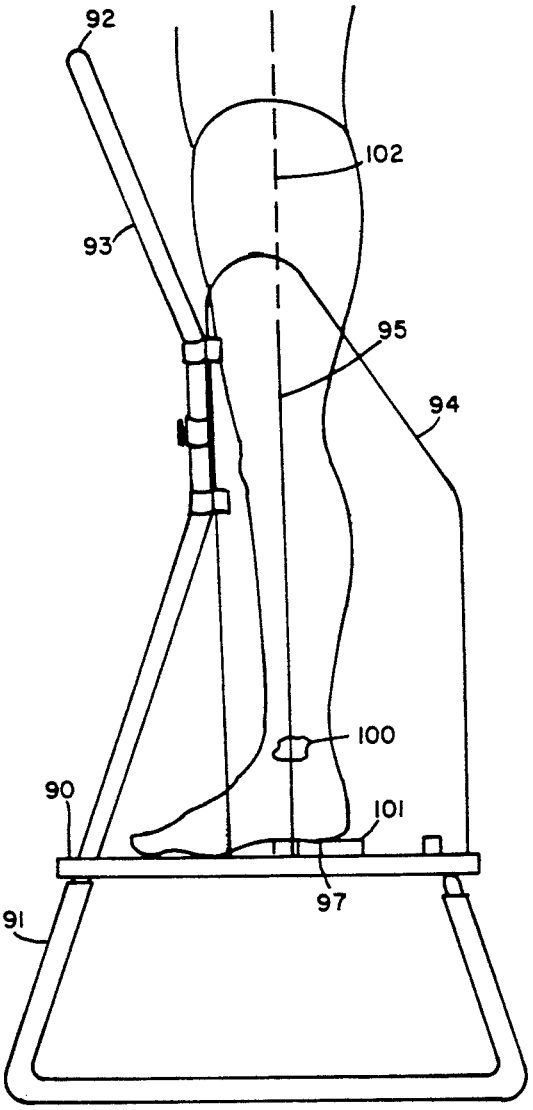
FIG. 17 is a side view of the apparatus shown in FIG. 16 illustrating the correction of the forefoot equinus condition shown in FIG. 16.

The measurement of this thickness is made when an individual stands barefoot on the table 90. The individual distributes his or her weight equally on both feet and equally between the forefoot and heel. If the operator positions the individual so his or her ankle 100 aligns with the fiducial line 95 on the side panel 94, anyone with forefoot equinus leans forward so the fiducial line 95 runs behind the center of the knees and hips as shown in FIG. 16. If the operator observes this condition, the operator places a wedge 101 of some thickness under the heel 97. When the appropriately sized wedge or block 101 is positioned, the individual stands with his or her weight evenly distributed, the fiducial line 95 on the side panel 94 extends up through the center of the ankle bone 100 and the knee and an extrapolated extension 102 of that line will extend through the center of the pelvis as shown in FIG. 17.

Thus this simple procedure, undertaken when the person stands normally with the weight reasonably balanced between the forefoot and the heel, provides a simple, easily administered test to determine the dimension of any compensating wedge for forefoot equinus. Moreover, a wedge of correct dimension then can be inserted below the heel cap 66 in footwear as shown in FIG. 18.

Figure 18:
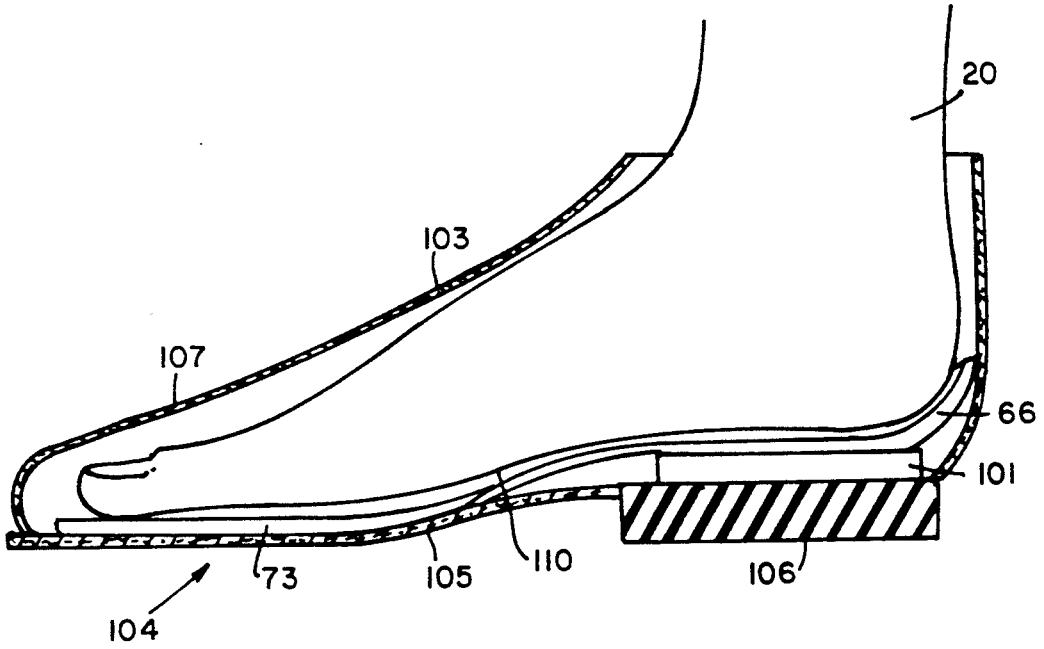
FIG. 18 is a sectional view of an article of footwear depicting the relationship of the footwear, a foot bed as described with reference to the other Figures, and an individual's foot.
Figure 19:
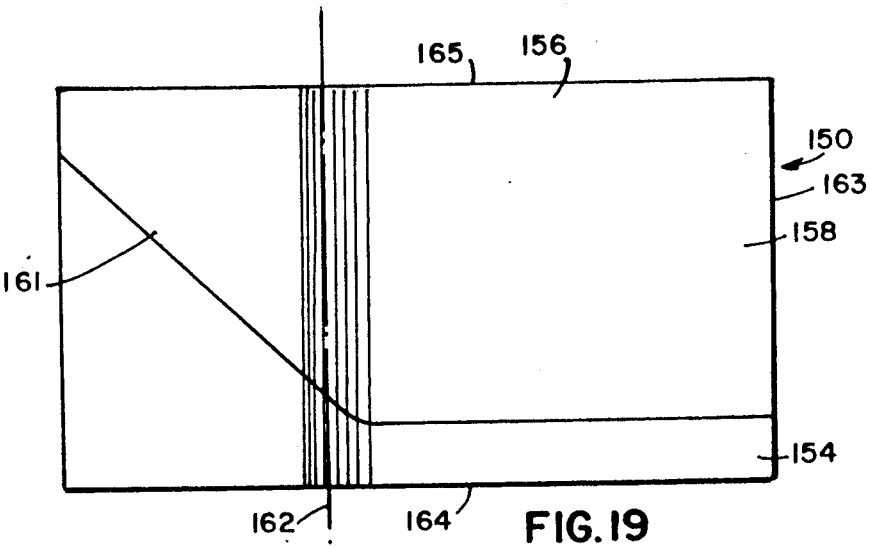
FIG. 19 is a top view of another embodiment of a pillow for use under a right foot.

Referring to FIG. 18, the basic components of any footwear 103 includes a lower portion 104 that has a sole 105 and a heel 106. An upper portion 107 connects to the lower portion and covers the upper portion of a foot and lower leg 20°. In accordance with this invention, a custom molded foot bed 73 is disposed between lower portion 104 and a plantar surface 110 of the foot 20° In the event the individual has forefoot equinus, a wedge 101 of appropriate compensating thickness is deposited between the heel 106 and the heel cap 66. If other gaps appear between the lower portion 104 and the bottom of the foot bed 73, appropriate wedges or pads may also be inserted if undue local movement of the foot bed occurs.

The pillows and stand shown in FIG. 15 simplify the customizing process and minimize operator training. The basic process includes a few simple steps. In one process, the operator first asks an individual to stand on the platform the operator notices the basic angulation of the foot, particularly in the transverse plane. The foregoing measurement for forefoot equinus can be made at this time also. Next the pillows 50 and 51 are placed back on the table 90 and positioned to correspond to the observed angulation. In order to provide some sense of comfort and reassurance, the operator may ask the individual merely to stand on the pillows 50 and 51 with their heels at an appropriate heel mark shown by reference numerals 111 and 112 in FIG. 15, these heels marks being positioned on the cover 64 and corresponding to different foot sizes. Placing the heel at the appropriate mark and then positioning the medial and lateral columns on either side of the line between blocks 52 and 53 shown in FIGS. 4 through 8 properly orient each foot on the respective one of the pillows 50 and 51. When the individual is comfortable, the operator constructs each molded foot bed.

First, a convection oven or similar heating device heats the blank to a temperature at which the adhesive material on the cap 66 (FIGS. 9 through 11) softens, typically in about one to two minutes. When the blank is properly heated for one foot, the individual lifts his or her foot off the pillow 50 or 51. The technician positions the heated blank on the appropriate pillow such that the end 71 of the cap 66 is positioned at the appropriate heel mark. Then the individual stands on the blank and compresses the pillow. The technician insures that the space between the third and forth toes bisects a lateral load column line that corresponds to the interface between the blocks 52 and 53. The person then stands in an anatomically correct stance aligned with the mark 95 until the blank cools, usually in about 1 minute.

The pillows shown in FIGS. 4 through 8 therefore provide a custom molded foot bed that positions an individual's foot in a balanced position. Stated differently the pillows establish a correct relative position between the forefoot and the rear foot when the subtalar joint is in a neutral position. Moreover the pillows establish this balanced position without any need for externally manipulating the individual's foot to achieve the balanced position and without the introduction of artificial or false varus.

Physicians and medically trained technicians often preferred to manipulate an individual's foot when they are custom manufacturing a foot bed or other orthotic appliance. Specifically they want to be able to move the forefoot relative to the rear foot manually. However, it is helpful in these manipulations if the foot is positioned close to the subtalar neutral position without introducing any false varus in the forefoot. The pillows shown in FIGS. 19 through 23 provide this positioning. That is, the pillows shown in FIGS. 19 through 23 move the foot toward a subtalar neutral position without introducing false varus to the forefoot.

These pillows are similar to the pillows shown in FIGS. 4 through 8. The basic modification occurs by eliminating any of the structure of the pillows shown in FIGS. 4 through 8 that extends under the forefoot section and by reducing the thickness of the layer 52 under the composite block formed of the wedges 54 and 56.

More specifically, FIGS. 19 through 23 disclose a pillow 150 for insertion under an individual's right rear foot. This composite pillow 150 rests, for convenience and handling, on a thin, dense block 152 that supports the pillow and provides a hard surface for being positioned on a planar support surface 153 such as a floor or stand.

Figure 20:
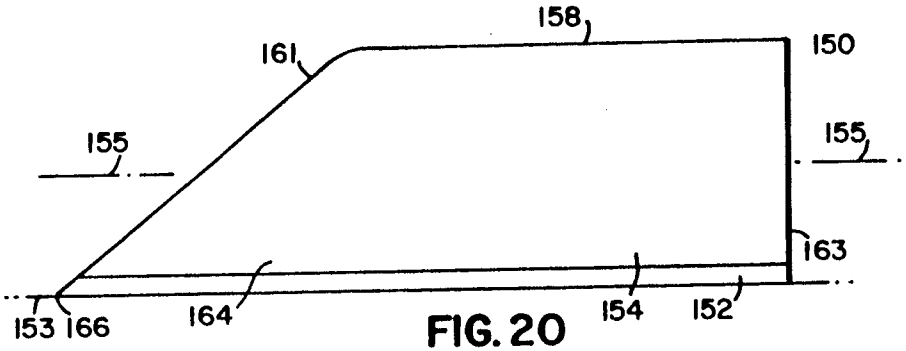
FIG. 20 is a side of the pillow of FIG. 19 when viewed from the left.
Figure 21:
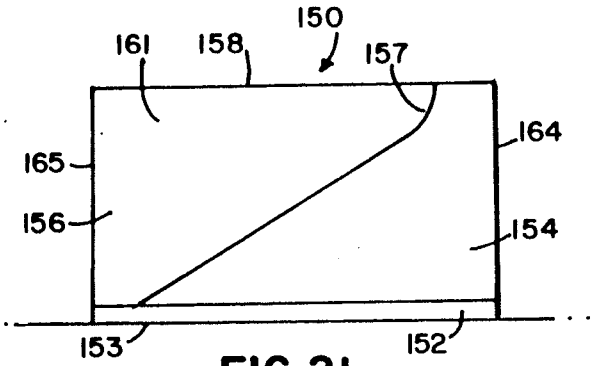
FIG. 21 is a front view of the pillow of FIG. 19.
Figure 22:
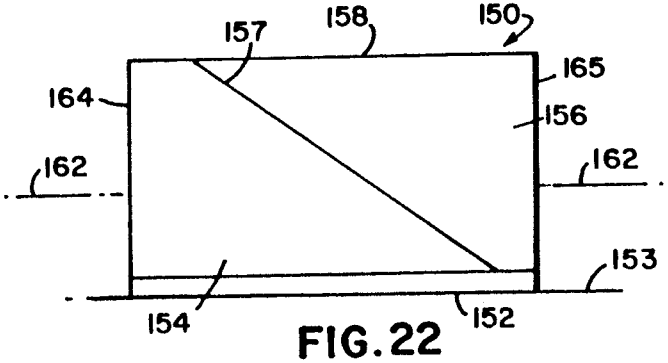
FIG. 22 is a rear view of the pillow of FIG. 19.

The pillow 150 shown in FIGS. 19 through 23, has a first foam shape in the form of a wedge 154 and a complementary foam shape in the form of a wedge 156. These wedges 154 and 156 extend along a sagittally extending axis 155. As shown in FIG. 22, the thicknesses of each of the wedges 154 and 156 varies in a frontal section. The wedges 154 and 156 are joined along an oblique line 157 formed by their hypotenuses so that the overall composite block has a substantially uniform thickness both when viewed along a frontal section such as shown in FIG. 22 and a sagittal section as shown in FIG. 20°.

Although a pillow can be formed as a cube it is preferred that, an elevated surface 158 on the main portion of the pillow 150 taper at a transition section 161 to the supporting structure 153.

The pillow 150, as shown in FIGS. 19 through 23, therefore has a back side 163, a center side 164 that is the side viewed from the left of the right pillow, an outside 165 that is viewed from the right of the right pillow and a front side 166. The densities of the blocks 154 and 156 correspond to the densities of the blocks 54 and 56 shown in FIGS. 4 through 8. The support 152 has a high density to act as a support structure.

Figure 23:
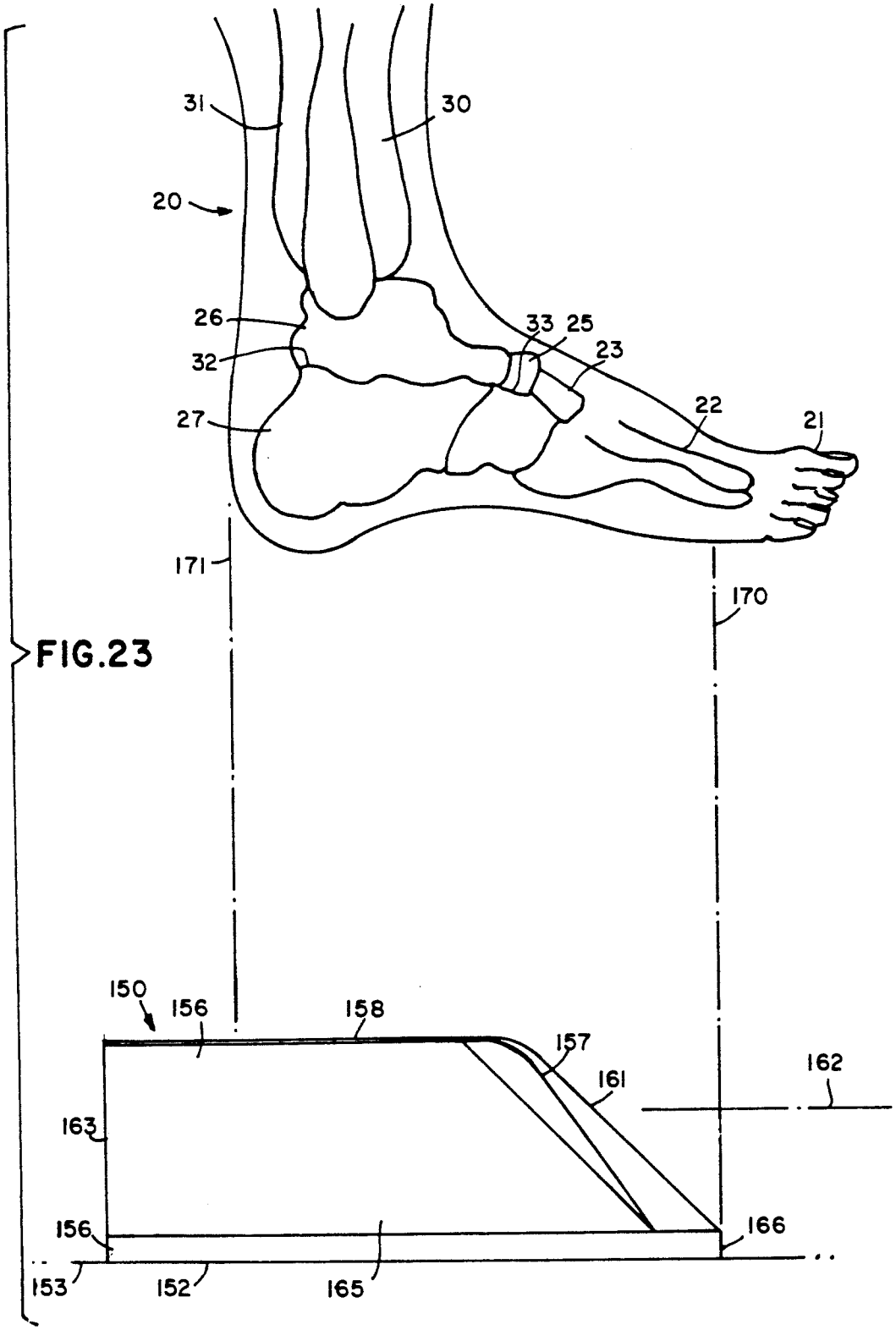
FIG. 23 is another side view from the right that depicts the orientation of a right foot and a pillow of FIGS. 19 through 22.

In use, the pillow 150 is positioned under the foot 20 shown in FIG. 23 such that the front edge 166 lies slightly behind the heads of the metatarsals 22 and behind the flanges 21. With a transition surface 161, the upper elevated surface 158 extends from behind the calcaneus 27 to a point forward of cuneiforms 23. The transition surface 161 can also be skewed with respect to a frontal plane in the same fashion as the pillow shown in FIGS. 4 through 8 is skewed. FIG. 23 depicts the skewing of the transition surface 161.

When an individual stands on and compresses the pillow 150, the foam blocks 154 and 156 begin to compress and produce a force that is oblique to the hypotenuse line or oblique line 157. This force acts as a rolling force on the rear foot medial column to move the foot toward a neutral position of the subtalar joint 32. This force also overcomes any tendency of the foot to evert. The foam blocks 154 and 156 also deform around the heel to position the heel and prevent adduction or abduction.

When the individual assumes a normal anatomical stance, the forefoot rests evenly on the supporting surface such as the floor 153. As the entire forefoot is then placed under a substantially constant loading, the forefoot remains parallel to the supporting surface. Moreover as the forces on the forefoot are relatively equal, there is no relative force applied to the forefoot medial column so the system does not introduce false varus to the foot.

Once an individual's foot is positioned by the pillows shown in FIGS. 19 through 23, trained personnel can manipulate the foot more easily to obtain a desired relationship between the various bones in the foot.

Moreover, once the manipulation is complete, the pillows can be used to produce supports for the plantar surface of the foot covering the area behind the metatarsal heads.

In summary, foot beds constructed in accordance with this invention produce a number of positioning forces on the feet. These forces replicate positioning forces produced by specially sloped composite, foam pillows. Certain of these forces move the foot toward an anatomically neutral position with forefoot locked against the rear foot and the subtalar joint is properly aligned. Other compensating forces provide a differential displacement from the anatomically neutral position to a balanced positioned. These forces, for example, contain and elevate the heel to position that compensates forefoot equinus. The apparatus associated with pillows facilitates the measurement of appropriate heel elevation for compensating forefoot equinus.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by patent of the United States is:

1. A composite pillow for supporting portions of the plantar surface of an individual's foot wherein the individual's foot is characterized by being divided sagittally into lateral column and medial column portions and divided frontally into rear foot and forefoot portions and by being subject to varus introduced by the application of an upward force to the plantar surface at the medial column of the forefoot portion, said pillow comprising first and second complementary foam shapes having, in increasing order, first and second densities, each having a said foam back variable thickness in a frontal section, said complementary foam shapes being stacked to form a composite block for insertion under the rear foot portion, said composite block having, uniform thickness in frontal and sagittal sections, and said foam shapes, when compressed under an individual's rear foot portion, applying a rolling force on the rear foot portion thereby to move the foot toward a subtalar neutral position without introducing false varus to the forefoot portion.

2. A composite pillow as recited in claim 1 wherein each of said complementary foam shapes is formed as a wedge that tapers in a sagittal direction, said wedges being oppositely faced and said wedge of said first density having maximum thickness for positioning under the lateral column portion of the rear foot portion, said wedges thereby being joined along a plane that is oblique to sagittal and frontal planes whereby compression of said composite block produces a force on the plantar surface of the rear foot portion that is substantially normal to the oblique plane for rolling the subtalar joint toward a balanced position.

3. A composite pillow as recited in claim 1 wherein an individual's rear foot portion includes a calcaneus and fatty tissue below the calcaneus and wherein said the said composite block defines a support plane at the bottom thereof and additionally includes a transition portion at a frontal portion thereof that slopes from the upper surface of said composite block frontally to the support plane, said elevated portion additionally producing a vertical force component on the calcaneus for elevating the rear foot portion and a cupping force around the rear foot portion at the calcaneus to contain the fatty tissue and said transition portion providing a force for stabilizing the position of the foot.

4. A composite pillow as recited in claim 3 wherein said pillow has a block of foam of a third density that is greater than the first and second densities for underlying said foam shapes thereby to provide the support plane.

5. A composite pillow as recited in claim 1 wherein an individual's foot includes a calcaneus and fatty tissue below the calcaneus and wherein said composite pillow additionally comprises a foam block of a third density greater than the first and second densities for supporting said complementary foam shapes thereby to elevate the upper surface of said composite pillow, said elevated portion additionally producing a vertical force component on the calcaneus for elevating the rear foot portion and a cupping force around the foot at the calcaneus to contain the fatty tissue.

6. A composite pillow as recited in claim 5 wherein said third block includes a extension thereof for lying underneath the lateral column portion of the forefoot portion, said extension producing an upward force on the plantar surface of the lateral column portion of the forefoot portion for locking the forefoot portion against the rear foot portion and defining a referenced neutral foot position, other portions of said composite pillow producing simultaneously a plurality of second lower anatomy compensating forces that cause said composite pillow to position the foot in a balanced position.

7. A composite pillow as recited in claim 6 additionally comprising a foam block of the first density that is adjacent to and has the same thickness as said third block extension, said foam block lying under the medial column portion of the forefoot portion for stabilizing the position of the individual's foot without applying any upward force on the plantar surface of medial column portion that could introduce false varus to the forefoot portion.

8. A composite pillow as recited in claim 7 wherein each of said complementary foam shapes in said rear foot portion is formed as a wedge that tapers in a sagittal direction, said wedges being oppositely faced and said wedge of said first density having maximum thickness of positioning under the lateral column portion of the rear foot portion, said wedges thereby being joined along a plane that is oblique to frontal and sagittal planes whereby compression of said composite block produces a force on the plantar surface of the rear foot portion that is substantially normal to the oblique plane for rolling the subtalar joint toward a balanced position.

9. A composite pillow as recited in claim..8 wherein the surface of said composite pillow slopes from the elevated surface that is positioned under the rear foot portion to the extension of said third density block under the forefoot portion, said sloping portion providing a force for stabilizing the position of the foot.

10. A composite pillow as recited in claim 9 wherein the portions of said composite pillow that lie under the rear foot and forefoot portions lie along an axis parallel to a sagittal plane and said transition sloped surface lies generally in a plane that is skewed with respect to said axis.

11. Apparatus for supporting an individual's foot in a balanced position wherein the individual's foot is characterized by a plantar surface and by being divided sagittally into lateral column and medial column portions and divided frontally into rear foot and forefoot portions, said apparatus including a pillow for insertion under the individual's foot comprising:

A. a base foam block of a predetermined thickness having a first density for underlying the rear foot and the forefoot lateral column portion, B. a second foam block of a lower density than said base. foam block and of the predetermined thickness in the same plane with said base block for underlying the forefoot medial column portion, and C. a composite foam block on the base foam block for positioning under the rear foot portion comprising a first foam shape having the same density as the second foam block and a second, complementary shaped foam shape having a density intermediate the densities of said base and second foam blocks, each of said foam shapes, having a variable thickness through a frontal section and said foam shapes being stacked to form said composite block with a portion thereof having a uniform thickness in frontal an sagittal sections, said base, second and composite foam blocks, when compressed under an individual's foot, producing a plurality of first forces that act on the foot for defining a referenced neutral foot position and second forces that compensate for an individual's lower anatomy thereby to support the foot in a balanced position for that individual.

12. Apparatus as recited in claim 11 wherein said composite block includes an upper horizontal surface that is elevated with respect to an upper horizontal surface at said second foam block, said composite block having a transition surface sloping from said upper horizontal surfaces of said composite block to said second foam block thereby to produce a force that stabilizes the position of the foot.

13. Apparatus as recited in claim 12 wherein said transition surface lies in a plane that is skewed with respect to a sagittal plane to provide a composite block that extends under the medial column for a greater distance that it extends under the lateral column.

14. Apparatus as recited in claim 12 additionally including stand means with a horizontal table for supporting said pillow and support means for assisting an individual in assuming an anatomically correct stance on the pillow.

15. Apparatus as recited in claim 14 wherein said stand means additionally includes a vertical fiducial mark affixed to said stand means for establishing an indication of the anatomically correct stance.

16. Apparatus as recited in claim 14 wherein said stand means supports said pillow for positioning under on foot and said apparatus includes a second pillow that is a mirror of the first pillow for positioning under the other foot.

17. Apparatus as recited in claim 14 additionally including thermosetting moldable foot beds for underlying and supporting the plantar surface of the foot, a said foot bed, when in a moldable condition, being located intermediate an individual's foot and supporting pillow whereby the forces produced when the individual stands on the pillow transfer through said foot bed to position the individual's foot in the balanced position and to mold the foot bed to the plantar foot surface while the foot is in the balanced position.

18. A method for positioning an individual's feet in a balanced position wherein each foot is characterized b being divided sagittally into lateral column and medial column portions and divided frontally into rear foot and forefoot portions and by being subject to varus introduced by the application of an upward force to the plantar surface at the forefoot medial column portion, said method comprising the steps of:

A. standing an individual in a vertical stance with each foot being supported by a composite pillow comprising first and second complementar foam shapes having, in increasing order, first and second densities and each said foam shape having a variable thicknesses in a frontal, section said complementary foam shapes being stacked to form a compost block for insertion under the rear foot portion, of portion of said composite block having uniform thickness in frontal and sagittal sections, and B. balancing the individual's weight substantially evenly on the feet thereby to enable each pillow to compress under the feet and to apply to the plantar surface of each foot simultaneously a rolling force on the rear foot portion thereby to move the foot toward a subtalar neutral position without introducing false varus to the forefoot portion.

19. A method as recited in claim 18 wherein the pillow additionally comprises a foam block having a density that is greater than the densities of the first and second foam shapes, said foam block having a portion underlying said composite block and an extension for positioning under the forefoot lateral column portion and a foam block having the first density for positioning under the forefoot medial column and wherein said method includes the additional step of inserting a moldable blank intermediate each pillow and corresponding foot whereby the pillow applies a plurality of forces through the blank to the foot thereby to position each foot in a balanced position and to conform each blank to the plantar surface of each foot in the balanced position.

20. A method as recited in claim 19 wherein said application of forces includes applying forces for rolling the subtalar joint toward the subtalar neutral position, displacing upward the forefoot lateral column portion and rolling the rear foot medial column portion thereby to lock the forefoot against the rear foot.

21. A method as recited in claim 19 wherein said application of forces includes applying a vertical force to the calcaneus and a cupping force to fatty tissue between the moldable blank and the calcaneus.

22. A method as recited in claim 19 wherein said application of forces includes applying forces to the moldable blank that conform said blank to the plantar surface of the foot when the foot is in its balanced position.

23. A method as recited in claim 22 wherein the application of other forces includes the step of applying a vertical force for supporting the arch of the foot.

24. A method as recited in claim 22 wherein the application of other forces includes the sep of applying a force that is oblique to the vertical for supporting the plantar surface of the foot adjacent the metatarsals and phalanges at the lateral column of the foot.

25. A method as recited in claim 19 additionally comprising the step of positioning the individual so that the individual's ankle, knee and pelvis are in vertical alignment.

* * * * *